United States Patent [19]

Cowan

[11] 4,167,971

[45] Sep. 18, 1979

[54] HANGER APPARATUS FOR SUSPENDING PIPES

[75] Inventor: William S. Cowan, West University Place, Tex.

[73] Assignee: Armco Inc., Middletown, Ohio

[21] Appl. No.: 915,830

[22] Filed: Jun. 16, 1978

[51] Int. Cl.[2] ..... E21B 43/10; E21B 23/00

[52] U.S. Cl. ..... 166/208; 166/214; 285/141

[58] Field of Search ..... 166/115, 208, 214; 285/141

[56] References Cited

U.S. PATENT DOCUMENTS

| | | | |
|---|---|---|---|
| 3,216,503 | 11/1965 | Fisher et al. | 166/208 |
| 3,227,218 | 1/1966 | Fisher, Jr. et al. | 166/208 |
| 3,378,077 | 4/1968 | Elliston | 166/115 |
| 3,420,308 | 1/1969 | Patch | 166/208 |
| 3,736,984 | 6/1973 | Garrett | 166/208 |
| 3,893,717 | 7/1975 | Nelson | 166/208 |
| 3,946,807 | 3/1976 | Amancharla et al. | 166/208 |

*Primary Examiner*—James A. Leppink

*Attorney, Agent, or Firm*—Roylance, Abrams, Berdo & Farley

[57] ABSTRACT

In hanger apparatus of the type comprising a hanger mandrel carried by an inner pipe, an outer body which can be carried by an outer pipe, and a resilient locking ring carried by the mandrel for connecting the mandrel to the hanger body to suspend the inner pipe the locking ring is in the form of an integral piece comprising a body portion, which cooperates with the hanger body to support the mandrel, and a dependent skirt which carries an inturned bottom flange cooperating with a retaining groove on the mandrel.

10 Claims, 8 Drawing Figures

HANGER APPARATUS FOR SUSPENDING PIPES

CROSS REFERENCES TO RELATED APPLICATIONS

The subject matter of this invention is related to my copending application Ser. No. 915,829 and Ser. No. 915,902, filed concurrently herewith.

BACKGROUND OF THE INVENTION

It has long been a common practice in the well art to suspend an inner pipe, typically a casing string, concentrically within an outer member, typically an outer casing string or a wellhead member, by means of a hanger comprising a hanger member connected to the inner pipe and having a downwardly directed shoulder which engages an upwardly directed shoulder on the outer member as the inner pipe is run in. As the art developed, it became necessary to minimize the annular space between the inner and outer hanger members and prior art workers have developed hangers employing a retractable hanger device carried by a mandrel on the inner pipe and capable of expanding into engagement with an outer hanger member when, as the inner pipe is run in, the mandrel reaches the outer hanger member. Pipe hangers of this type have become particularly important with the advent of offshore practices in which the hanger is located at the mudline and the outer pipe above the wellhead is of the same diameter as the outer casing below the wellhead and the annular space available for the hanger is relatively small. Such hangers sometimes employ an annular retractable hanger means in the form of a circular series of mutually independent segments with each segment being spring-biased outwardly as shown, for example, in U.S. Pat. No. 3,472,530 Fowler. In other prior-art devices of this type, the retractable hanger device is in the form of a split ring as seen, for example, in the following U.S. patents:

U.S. Pat. No. 3,420,308; Putch
U.S. Pat. No. 3,741,589; Herd et al.
U.S. Pat. No. 3,800,869; Herd et al.
U.S. Pat. No. 3,971,576; Herd et al.
U.S. Pat. No. 3,974,875; Herd et al.

Though hangers of this general type have achieved considerable success, they still present problems which increase in severity as the annular space available at the hanger decreases and the weight of the pipe string to be suspended increases. It has proved difficult to design either an assembly of segments or an integral split ring which is dimensioned to be accommodated in the small annular space available adequately strong to carry the heavy loads applied by the suspending pipe and, while adequately resiliently compressible to successfully enter the outer body from which the pipe is to be suspended, is yet effective to come automatically into full positive engagement with the outer body as landing of the string is completed. Further, hangers of this type require that the retractable hanger device, whether it be made up of a plurality of segments or be in the form of a split ring, be initially secured in releasable fashion to the mandrel in such fashion that, once the retractable hanger device has engaged the outer body, further downward movement of the mandrel is possible to complete the operation. In some cases, the segments or the ring have been releasably secured to the mandrel by shear members, but this has the disadvantage that care must be taken to avoid portions of the shear member dropping into the annulus to become damaging debris. While other releasable retaining devices have been proposed, there has been a continuing need for a simple and more dependable device.

OBJECTS OF THE INVENTION

A general object of the invention is to provide hanger apparatus of the type described in which the retractable hanger device is in the form of a split ring which, while of simple configuration, operates to assure that the mandrel will be properly locked to the outer hanger body.

Another object is to provide such a hanger apparatus in which the split ring is adequately retained in its initial position on the mandrel by a highly simplified releasable retaining device.

A further object is to devise such an apparatus wherein the ring and the mandrel coact to assure that the ring will be properly engaged with the outer hanger body once the ring has been released from its initial position on the mandrel.

SUMMARY OF THE INVENTION

Broadly considered, hanger apparatus according to the invention comprises an outer hanger body, which can be carried by an outer string of casing, and which includes at its upper end an upwardly directed annular camming surface and, below that surface, at least one transverse annular inwardly opening groove. The apparatus further comprises a tubular hanger mandrel and retractable lock means in the form of a resilient split ring, the ring being carried by the mandrel and disposed within an elongated outwardly opening annular recess defined by the outer surfaces of the mandrel. The mandrel presents an annular upwardly facing stop shoulder at the bottom end of the recess and an annular downwardly facing load-bearing shoulder at the upper end of the recess. The split ring is axially shorter than the recess and comprises a main body portion carrying at least one transverse annular outwardly projecting rib, to coact with at least one groove of the outer body, and a relatively thin skirt which depends from the main body and is substantially more flexible and resilient than the main body. At its lower end, the skirt has a downwardly and inwardly tapering camming surface to cooperate with the camming surface presented by the outer body and assure that, as the combination of the mandrel and ring is lowered into the outer body, the ring will be inwardly compressed and will properly enter the outer body. The lower end of the skirt is turned inwardly to present a transverse annular inwardly projecting retaining flange. At the lower end of the recess, the mandrel is provided with a transverse annular outwardly opening groove to receive the retaining flange.

BRIEF DESCRIPTION OF THE DRAWINGS

In order that the manner in which the foregoing and other objects are achieved according to the invention can be understood in detail, particularly advantageous embodiments of the invention will be described with reference to the accompanying drawings, which form part of the original disclosure in this application, and wherein.

DETAILED DESCRIPTION OF THE EMBODIMENT OF FIGS. 1–2

Figure 1:
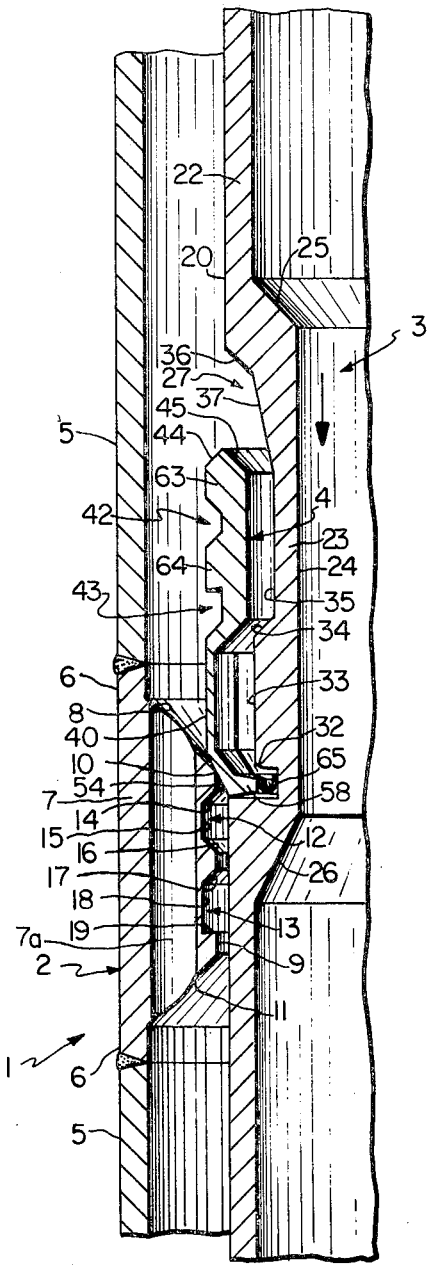
FIGS. 1–1C are fragmentary longitudinal cross-sectional views illustrating a hanger apparatus according to one embodiment of the invention, the figures being sequential, progressing from illustration of the initial contact of the locking ring with the hanger body, in FIG. 1, to illustration of the hanger completely landed and locked, in FIG. 1C.

Referring first to FIG. 1, the hanger apparatus 1 of this embodiment includes a hanger body 2, a hanger mandrel 3 and a locking ring 4. In this embodiment, hanger body 2 is carried by an outer pipe 5, such as a string of casing, and the hanger body is tubular, with an outer diameter equal to that of casing 5. End portions 6 of body 2 are right cylindrical and have the same wall thickness as the casing, each end portion being rigidly secured, as by welding, to the end of a different joint of the casing string. An intermediate portion 7 of body 2, which extends for most of the length of that body, is substantially thicker than end portions 6 and projects inwardly, being bounded at its upper end by a frusto-conical camming surface 8 which tapers downwardly and inwardly to join the right cylindrical inner surface 9 of portion 7 in an annular corner 10. The lower end of intermediate portion 7 is defined by an upwardly and inwardly tapering frusto-conical surface 11. Portion 7 is provided with a plurality of longitudinal through bores 7*a* which are spaced in a circular series and provide for fluid circulation through hanger body 2.

Inner surface 9 of portion 7 is interrupted by an upper transverse annular inwardly opening groove 12 and, spaced therebelow, a lower transverse annular inwardly opening groove 13. Upper groove 12 serves as a locking groove and is defined by a frusto-conical upper wall 14, which tapers upwardly and inwardly, a right cylindrical bottom wall 15, concentric with the longitudinal axis of pipe 5, and a frusto-conical load-bearing lower wall or shoulder 16 which tapers downwardly and inwardly. Lower groove 13 serves as a catching groove and has a frusto-conical upwardly and inwardly tapering upper wall 17, a right cylindrical bottom wall 18, concentric with the longitudinal axis of pipe 5, and a lower catching shoulder 19 which is frusto-conical and tapers upwardly and inwardly at a small angle, advantageously about 5°. Walls 14, 16 and 17 are advantageously each disposed at an angle of 45° relative to the pipe axis.

Hanger mandrel 3 is an integral body having a right cylindrical outer surface 20 equal in diameter to the outer surface of the inner pipe 21 to be suspended, typically a casing string. End portions 22 of the mandrel are of the same wall thickness as the inner pipe and are secured rigidly thereto, as by welding. An intermediate portion 23 of mandrel 3 has a right cylindrical inner surface 24 which extends for a substantial portion of the length of the mandrel and is of significantly smaller diameter than that of the inner surfaces of the end portions 22, surface 24 being joined to the inner surfaces of end portions 22 by frusto-conical shoulders 25 and 26. Portion 23 of the mandrel is provided with a stepped annular outwardly opening recess 27 which extends longitudinally for most of the length of intermediate portion 23 and is long as compared to portion 7 of the hanger body 2. The lower end of recess 27 is defined by a transverse annular stop shoulder 28 which faces upwardly and lies in a plane at right angles to the longitudinal axis of the mandrel. Shoulder 28 also forms the lower wall of a transverse annular outwardly opening retaining groove 29. Groove 29 has a cylindrical bottom wall 30, concentric with the longitudinal axis of the mandrel, and a transverse annular upper wall 31 parallel to shoulder 28, the outer periphery of wall 31 being chamfered to provide a short downwardly and inwardly tapering frusto-conical camming surface 32.

Recess 27 is further defined by a larger diameter right cylindrical surface 33, which commences at camming surface 32, an upwardly and inwardly tapering frusto-conical surface 34 at the upper end of surface 33, a smaller diameter right cylindrical surface 35, which commences at the upper end of surface 34, a frusto-conical downwardly and inwardly tapering load-bearing shoulder 36 constituting the upper end of recess 27, and a frusto-conical intermediate surface 37 tapering at a small angle downwardly and inwardly to connect the inner periphery of shoulder 36 and the upper end of surface 35. Shoulder 36 is at an angle of 45° to the pipe axis so as to be parallel to load-bearing shoulder 16 of groove 12 when the mandrel and hanger body are concentric.

Figure 2:
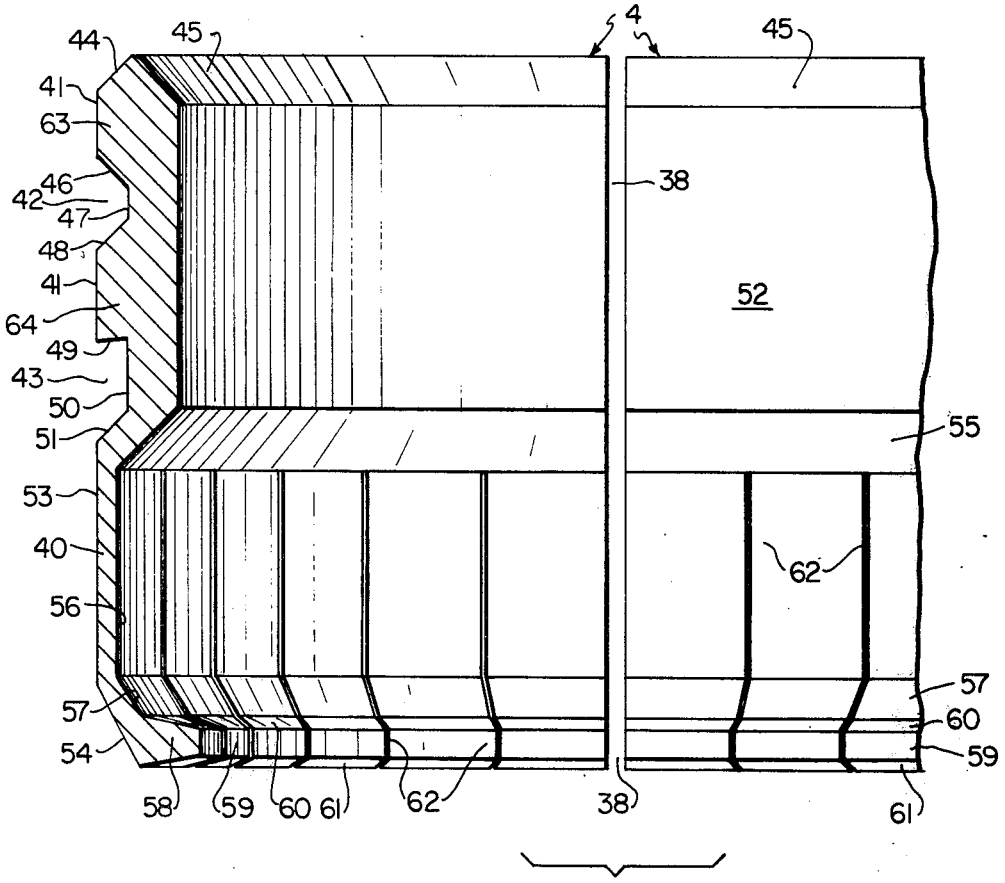
FIG. 2 is a view, partly in longitudinal cross-section and partly in side elevation, of the locking ring of the apparatus of FIG. 1.

Shown in detail in FIG. 2, locking ring 4 is an integral resilient metal ring split longitudinally throughout its full length at 38. Ring 4 comprises an upper annular main body portion 39 and a skirt 40, main body portion 39 being thick in comparison with the skirt, and the skirt depending from the main body portion. Main body portion 39 has a right cylindrical outer surface 41 interrupted by transverse annular outwardly opening grooves 42 and 43. The upper end of body portion 39 is defined by converging frusto-conical shoulders 44 and 45, shoulder 44 tapering from outer surface 4 upwardly and inwardly at 45° to the longitudinal axis of the ring, and shoulder 45 tapering downwardly and inwardly at 45° to the axis of the ring.

Groove 42 is defined by an upper frusto-conical wall or shoulder 46 which tapers downwardly and inwardly so as to be parallel with shoulder 45, a right cylindrical bottom wall 47, and a lower frusto-conical wall 48 which tapers upwardly and inwardly. Groove 43 is defined by a frusto-conical upper wall 49 or shoulder which tapers upwardly and inwardly at the same small angle as does catching shoulder 19 of body 2, a right cylindrical bottom wall 50, and a frusto-conical lower wall 51 which tapers upwardly and inwardly at 45°. Body portion 39 has a main right cylindrical inner surface 52.

Skirt 40 is markedly thinner, and therefore markedly more resilient, than is body portion 39. The outer surface of the skirt is defined by the lower wall 51 of groove 43, a right cylindrical outer surface portion 53, and a downwardly and inwardly tapering frusto-conical camming surface 54. The inner surface of skirt 40 is defined by an upwardly and inwardly tapering frusto-conical surface portion 55, a right cylindrical inner surface portion 56, and a downwardly and inwardly tapering frusto-conical surface portion 57. Formed integrally with skirt 40 at the bottom end thereof is a transverse annular inwardly directed retaining flange 58 defined by a right cylindrical inner wall 59, which is concentric with the longitudinal axis of the ring, and converging upper and lower frusto-conical side surfaces 60 and 61. To increase its resiliency, skirt 40 is provided with a plurality of longitudinal slits 62 each extending from surface portion 55 throughout the length of the skirt and opening through flange 58.

Figure 1A:
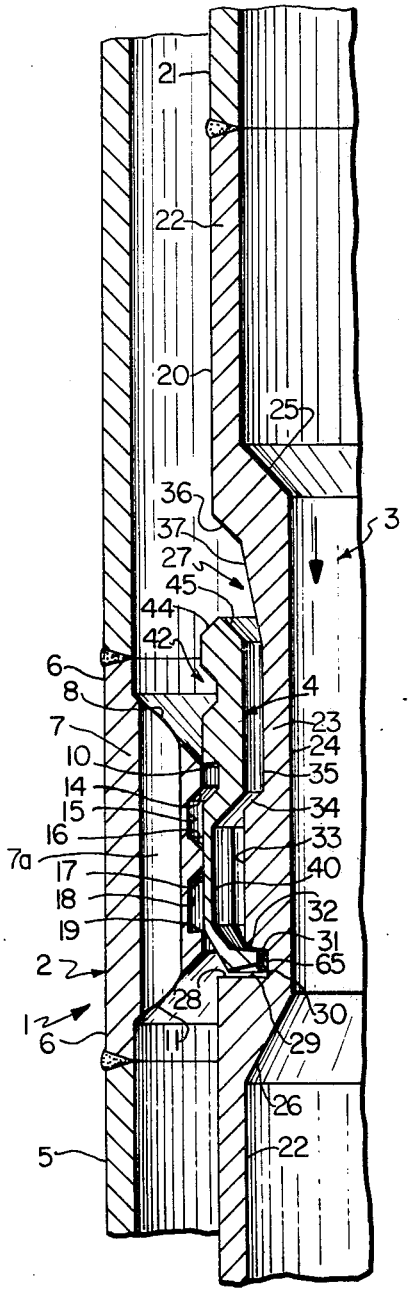
Figure 1B:
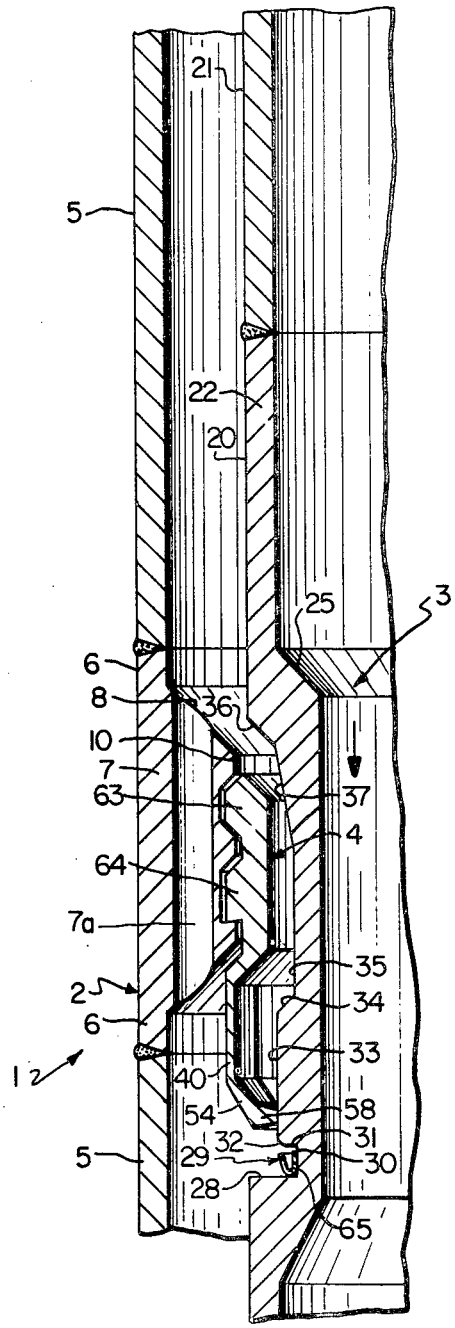
Figure 1C:
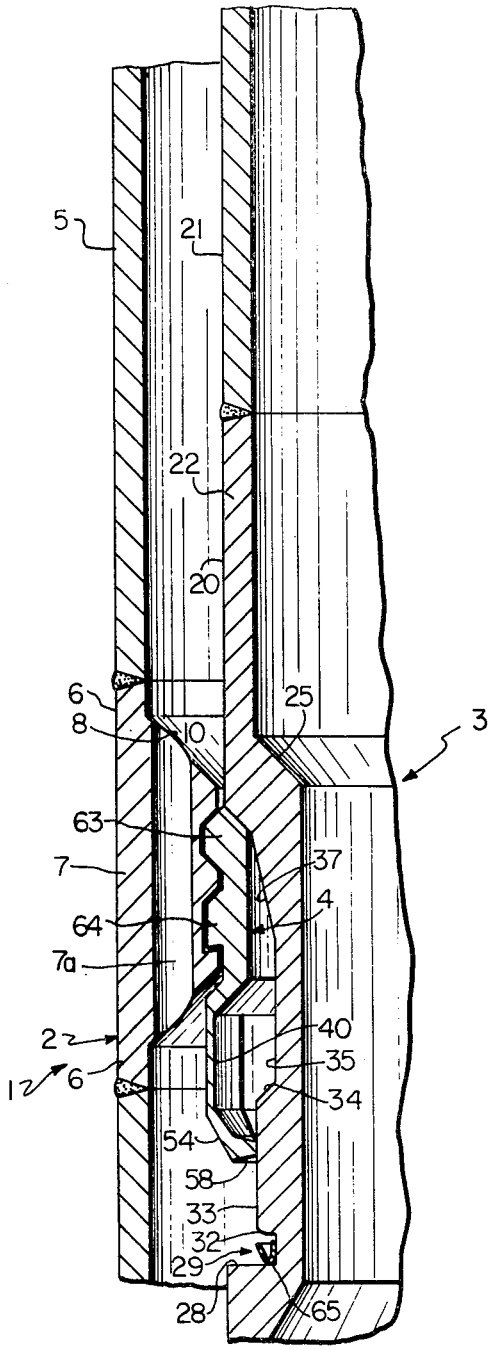

At the upper end of ring 4, shoulder 44, upper wall 46 of groove 42, and the portion of surface 41 between shoulder 44 and groove 42 combine to define a transverse annular locking rib 63. Similarly, lower wall 48 of groove 42, upper wall 49 of groove 43 and the portion of surface 41 between walls 48 and 49 combine to define a transverse annular catching rib 64. Ribs 63 and 64 are spaced apart by a distance such that the portion of body 2 defined by surfaces 16,17 and the portion of surface 9 therebetween can be fully accommodated in groove 42. The axial width of rib 64 is very slightly smaller than the axial width of groove 13. Thus, rib 63 can mate fully with groove 12 and, with rib 63 so mated, rib 64 is fully accommodated by groove 13 and shoulder 49 is spaced very slightly above shoulder 18, as seen in FIG. 1C.

The inwardly projecting bottom flange 58 on the skirt of locking ring 4 is dimensioned to be accommodated by groove 29 of mandrel 3. Ring 4 is installed on mandrel 3 before the mandrel is rigidly secured, as by welding, to two joints of the inner pipe, installation being accomplished by expanding the split ring and slipping the ring over one end of the mandrel, then moving the ring axially until flange 58 is aligned with groove 29, at which point the ring is allowed to relax so that the inner periphery of flange 58 is disposed just within the mouth of groove 29, as seen in FIG. 1. Advantageously, an annular radially resilient sheet metal spring 65 of generally U-shaped radial cross section is disposed within groove 29, with the U of the spring opening upwardly, to maintain ring 4 approximately centered on the mandrel. When the ring is in its initial position, the juncture between surfaces 54 and 61 engages shoulder 28, and the inner surface 59 of flange 58 is in a position such that, if the mandrel is moved downwardly relative to ring 4, the corner presented by surfaces 60 and 59 will engage camming surface 32. The length of cylindrical surface 33 of the mandrel is such that the portion of the mandrel defined by the upper wall of groove 29, surface 33 and surface 34 can be accommodated between flange 58 and surface 55 of the skirt of the ring. Similarly, main body portion 39 of ring 4 is shorter than the space between surface 34 and shoulder 36, so that the main body of the ring can be freely accommodated in that portion of recess 27 between those two surfaces.

Installation of outer pipe 5 positions hanger body 2 at that location from which the inner pipe 21 is to be suspended. As the inner pipe is run in, ring 4 remains in the position on mandrel 3 seen in FIG. 1, being retained by engagement of flange 58 in groove 29. As the intermediate portion 23 of the mandrel enters hanger body 2, surface 54 of the skirt of the locking ring engages the corner 10 presented at the inner periphery of camming surface 8 of body 2. Further downward movement of the inner pipe causes locking ring 4 to be compressed inwardly. Initially, such compression is concentrated in skirt 40, occurring both because of the relatively thin wall of the skirt and because of the provision of slits 62. As downward movement of the inner pipe continues, such compression progresses until all of surface 54 has passed corner 10, and the outer cylindrical surface 53 of skirt 40 is now embraced by the inner cylindrical surface 9 of intermediate portion 7 of hanger body 2, as seen in FIG. 1A. At this stage, the corner defined by shoulder 49 and surface 41 can engage surface 8, and main body portion 39 of the ring is also compressed, such compression being allowed by skirt 38. Throughout such further downward movement, flange 58 remains engaged in groove 29 to releasably hold ring 4 in its initial axial position relative to mandrel 3.

Continued downward movement of the combination of mandrel 3 and ring 4 causes rib 64 to move past upper groove 12, the lower shoulder 16 serving to cam that rib inwardly again as downward movement of the ring continues. Thus, catching rib 64 passes downwardly to the location of catching groove 13. As rib 64 begins to mate with groove 13, the locking rib 63 simultaneously begins to mate with locking groove 12 and, since the locking ring is now resiliently contracted, the ring begins to spring outwardly. Thus, catching rib 64 has begun to enter groove 13 as the ring further descends, and catching shoulder 49 of the ring is now partly overlapped with catching shoulder 19 of the hanger body. As downward movement continues, shoulder 49 engages shoulder 19 and the, e.g., 5° taper of these two shoulders enables the two shoulders to help move ring 4 outwardly until, as seen in FIG. 1B, locking rib 63 has initially mated with locking groove 12.

When shoulder 49 engages shoulder 19, further downward movement of ring 4 is prevented. Mating of the main body portion 39 of ring 4 with hanger body 2 not only allows but positively assures relaxation of ring 4 to substantially its fully relaxed diameter. Accordingly, with downward movement of the ring now prevented by engagement of shoulders 49 and 19, the corner of flange 58 defined by surfaces 59 and 60 is disposed to be engaged by the camming surface 32. Further downward movement of mandrel 3, as lowering of the inner pipe continues, causes flange 58 to ride over camming surface 32 so that the flange embraces surface 33 of the mandrel, as seen in FIG. 1B. Since surface 33 has a diameter slightly larger than the relaxed diameter of inner surface 59 of flange 58, skirt 40 is now resiliently distorted outwardly, tending further to assure proper mating of the locking ring with the hanger body. Continued downward movement of the mandrel causes the load-bearing shoulder 36, at the upper end of recess 27, to engage load-bearing shoulder 45 of the locking ring, forcing shoulder 46 of the locking ring into load-bearing engagement with lower wall 16 of groove 12. Since shoulders 36, 45, 46 and 16 are all at 45° to the pipe axis, the total downwardly acting load presented by the inner string of pipe is applied in a straight line at right angles to the four parallel surfaces.

The elongated intermediate frusto-conical surface 37 of mandrel 3 serves only to assure final centering of locking ring 4 relative to the mandrel as the load-bearing surfaces come into full engagement. Engagement of the load-bearing surfaces under the heavy downward load applied by the inner pipe string serves to force body portion 39 of the locking ring radially outwardly so that locking rib 63 is forced further into locking groove 12.

Ring 4, with its camming surface 54, its resilient skirt and catching shoulder 49, has the capability of distinguishing groove 13 and the catching shoulder 19 of that groove from other obstructions within outer pipe 5 which are encountered during the trip of the combination of the mandrel and locking ring down pipe 5. The manner in which ring 4 enters the intermediate portion 7 of body 2 and then, in effect ignores presence of groove 12 as rib 64 passes that groove, is typical of the manner in which the locking ring responds to obstructions and ignores the obstructions so far as its catching action is concerned. On the other hand, once catching rib 64 has reached catching groove 13, engagement of shoulder 49 with shoulder 19 positively causes flange 58 to be released from groove 29 and positively causes the locking ring to expand radially to assure full engagement with hanger body 2.

When it is desired to remove the inner pipe string 21, application of an upward strain to that pipe string causes the inner pipe string to move upwardly through the locking ring 4. Inner surface 59 of flange 58 rides on cylindrical surface 33 of the mandrel until groove 29 reaches the position of flange 58 and the flange snaps back into groove 29. At this point, the juncture between surfaces 54 and 61 of ring 4 is again engaged with shoulder 28. Continuation of the upward strain on the inner pipe string now urges ring 4 upwardly, causing shoulder 44 to engage shoulder 14 of body 2 and simultaneously causing shoulder 48 of ring 4 to engage shoulder 17 of body 2. Those engaged shoulders now serve to cam ring 4 radially inwardly, such radial compression of the ring being permitted by slit 38. Thus, ribs 63 and 64 of the locking ring are disengaged from grooves 12 and 13 and the locking ring passes upwardly through body 2, the inner pipe string now being free for its return trip to the surface.

While catching shoulders 19 and 49 advantageously taper at an angle of about 5° relative to planes at right angles to the longitudinal pipe axis, the angle of taper of those shoulders can be 2–10 degrees, smaller angles having a reduced tendency to urge the locking ring outwardly, and larger angles having an increased danger of damage to the corners at the peripheries of the shoulders. While shoulders 36, 45, 46 and 16 are advantageously at 45°, the angle of taper of these shoulders can be 30°–60°, so long as all four shoulders are essentially parallel to each other.

THE EMBODIMENT OF FIGS. 3–3B

Figure 3:
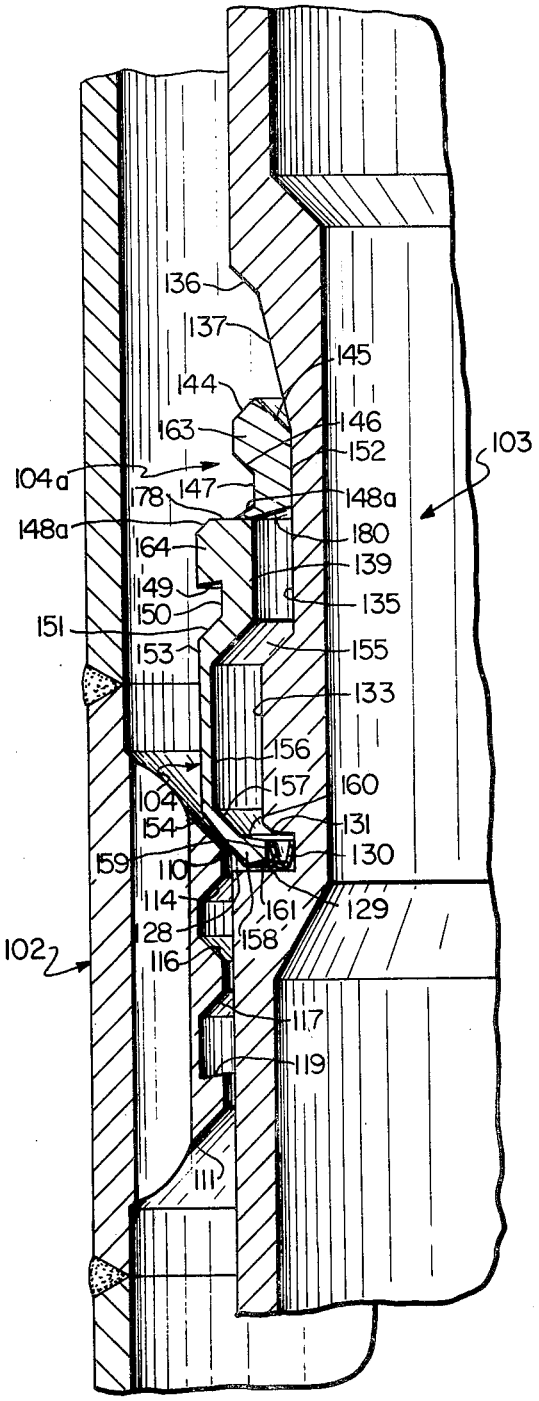
FIGS. 3–3B are fragmentary longitudinal cross-sectional views, similar to FIGS. 1, 1B and 1C, respectively, illustrating a hanger apparatus according to another embodiment of the invention.

In this embodiment of the invention, the retractable lock means comprises two split rings, one being indicated generally at 104 and carrying the catching rib 164, and the other being indicated generally at **104*a* and carrying the locking rib 163. Ring 104 has a flat transverse annular upper end face 178 which lies in a plane at right angles to the longitudinal axis of mandrel 103. At its outer periphery, end face 178 joins a short upwardly and inwardly tapering frusto-conical surface 148*a* which corresponds to the outer portion of surface 48, FIG. 2. Otherwise, ring 104 is identical to that portion of ring 4, FIG. 2, which extends below surface 48, FIG. 2. Thus, ring 104 includes surfaces 149–151 and 153–157, as well as inwardly directed retaining flange 158 defined by surfaces 159–161. As seen in FIG. 3, ring 104 is of such a diameter that, when relaxed and undistorted, flange 158 is only partially engaged in groove 129 of mandrel 103, and camming surface 154 of the ring is disposed to engage corner 110 presented by outer hanger body 102. The thicker main body portion 139 of ring 104** has an inner diameter, when relaxed and undistorted, such that the main body of the ring is spaced well outwardly from the mandrel.

Ring **104*a* has a transverse annular frusto-conical bottom end face 180 which tapers upwardly and inwardly at a small angle. The outer surface of ring 104*a* includes a lower frusto-conical upwardly and inwardly tapering surface 148*a*, and surfaces 144–147 which are in all respects the same as the corresponding surfaces of ring 4, FIG. 2, save for the fact that, when relaxed and undistorted, ring 104*a* is substantially smaller in diameter than is ring 4, FIG. 2. The relaxed diameter of ring 104*a* is such that, when relaxed, that ring slidably embraces the smaller right cylindrical surface portion 135 of mandrel 103. The dimensions of rings 104 and 104*a*, and of mandrel 103 are such that, when the parts are in the positions seen in FIG. 3, with both rings 104 and 104*a* relaxed and undistorted, with flange 158 engaged in groove 129, the juncture between surfaces 145 and 152 of ring 104*a* is engaged with the juncture between surfaces 135 and 137 of mandrel 103. With the parts in these positions, the outer peripheral portion of bottom end face 180 of ring 104*a* slidably engages the upper end face 178 of ring 104**.

Figure 3A:
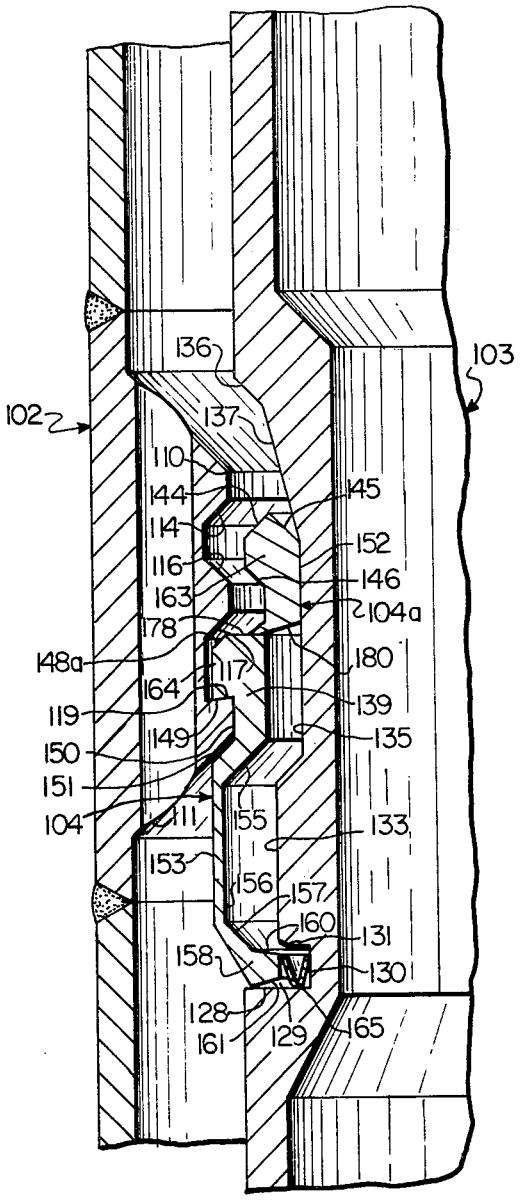

When the combination of mandrel 103 and rings 104, **104*a* is moved downwardly, relative to hanger body 102, from the position seen in FIG. 3, engagement of corner 110 with surface 154 causes ring 104 to be radially compressed, with flange 158 being inserted further into groove 129 against the biasing action of spring 165. The combination of mandrel 103 and rings 104 and 104*a* thus can move downwardly through hanger body 102, until catching shoulder 149 engages catching shoulder 119 and the parts reach the positions seen in FIG. 3A. At this stage, flange 158 is still engaged in groove 129, and while catching rib 164 is now predominantly engaged in the corresponding catching groove in hanger body 2, ring 104*a* remains slidably engaged with mandrel surface 135. Further downward movement of the combination of the mandrel and rings 104, 104*a* causes flange 158 to disengage from groove 129, engagement of shoulders 149 and 119 preventing further downward movement of both rings 104 and 104*a*. As downward movement of mandrel 103 continues, frusto-conical mandrel surface 137 enters ring 104*a* and causes that ring to expand, with shoulder 146 coming into engagement with shoulder 116 and with shoulder 136 of the mandrel coming into engagement with shoulder 145 of ring 104*a***.

Figure 3B:
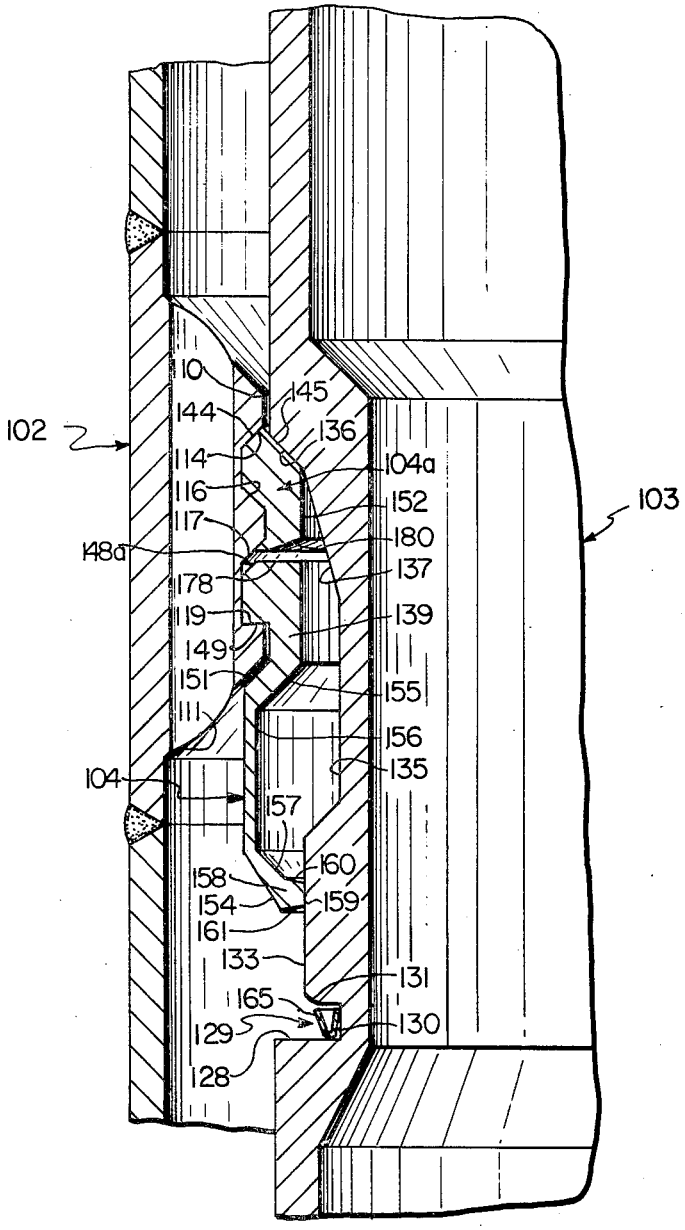

Frusto-conical mandrel surface 137 serves to expand ring **104*a* until locking rib 163 is fully engaged in the corresponding locking groove presented by hanger body 102. Since downwardly and inwardly tapering shoulders 116 and 146 have come into engagement as the mandrel approaches its final position, ring 104*a* is forced outwardly by surface 137 so that, when the parts reach the fully locked positions seen in FIG. 3B, ring 104*a* is spaced slightly above ring 104 and ring 104 therefore does not carry any of the load applied by the mandrel. That load is transferred from the mandrel through ring 104*a* to hanger body 102 along a straight line at right angles to surfaces 136, 145, 146 and 116**.

When it is desired to recover the inner pipe string, applying an upward strain on that pipe string causes stop shoulder 128 of mandrel 103 to come into engagement with the lower end of ring 104, flange 158 then again being free to enter groove 129. Accordingly, as the mandrel is moved upwardly, ring 104 is moved upwardly with the mandrel until surface **148*a* engages surface 117 of body 102 and ring 104 is therefore cammed inwardly until rib 164 disengages from the catching groove presented by the outer body 102. Such camming action is aided by coaction of surfaces 151 and 111. During initial upward movement of mandrel 103 and ring 104, the locking ring 104*a* remains generally in place. End face 178 of catching ring 104 then comes into engagement with the lower end face of ring 104*a*, and ring 104*a* is forced to travel upwardly with the mandrel and ring 104. As a result, surfaces 144 and 114 come into contact, so that ring 104***a* cannot travel upwardly with the mandrel. As the mandrel continues moving upwardly, surface 137 is withdrawn from ring 104*a* and that ring contracts to its normal relaxed condition and again slidably embraces surface 135. The parts have thus returned to the positions seen in FIG. 3 and rings 104 and 104*a* remain in these positions during the return trip of the pipe string.

In this embodiment, the upper wall 131 of groove 129 is a single frusto-conical surface which tapers at a small angle downwardly and inwardly from cylindrical surface 133 to the bottom surface 130 of the groove. Advantageously, the angle of taper of wall 131 can be the same as for surface 160 of flange 158.

Though the illustrative embodiments shown and described employ a single locking groove, as at 12, FIG. 1, and a single locking rib 25 at 63, FIG. 1, it will be understood that two or more locking grooves and a corresponding number of locking ribs can be employed.

What is claimed is:

1. In a hanger apparatus for suspending an upright inner pipe from an outer pipe or other annular member, the combination of a tubular hanger body to be carried by the outer member, said hanger body having an upwardly directed transverse annular camming surface at the upper end of the hanger body, and at least one transverse annular inwardly opening groove spaced below said camming surface;

a tubular hanger mandrel to be carried by the inner pipe and having a transverse annular outwardly opening recess, a transverse annular upwardly directed stop shoulder at the lower end of said recess, a transverse annular outwardly opening retaining groove within said recess and adjacent said stop shoulder, a transverse annular downwardly directed load-bearing shoulder at the upper end of said recess, a first cylindrical outer wall portion of larger diameter extending upwardly from said retaining groove, and a second cylindrical outer wall portion of smaller diameter located between said first cylindrical wall portion and said downwardly directed load-bearing shoulder; and annular lock means carried by said mandrel, said lock means being disposed in said recess and comprising an integral resilient split ring having an annular body portion and a skirt depending from said body portion, said body portion having a transverse annular outwardly projecting rib dimensioned to at least partially engage in said inwardly opening groove of said hanger body when said body portion is relaxed and undistorted, said skirt being thin as compared to said body portion and having a transverse annular inwardly directed flange at its lower end, said flange being dimensioned to engage in said retaining groove when said skirt is relaxed and undistorted, the bottom end portion of said skirt having an outer transverse annular downwardly and inwardly tapering camming surface adapted to be engaged by said upwardly directed camming surface of the hanger body as the combination of the mandrel and lock means is inserted downwardly into the hanger body, downward insertion of the combination of the mandrel and lock means into the hanger body causing the lock means to be resiliently contracted radially while said skirt passes said inwardly opening groove, the lock means expanding resiliently to engage said rib in said inwardly opening groove when the rib reaches the inwardly opening groove, and further downward movement of the mandrel then causing said flange and the lower end portion of the skirt to expand to allow said flange to disengage from said retaining groove and slidably embrace said first outer wall portion as the mandrel descends to bring said downwardly directed load-bearing shoulder into engagement with the lock means.

2. The combination defined in claim 1, wherein the hanger body comprises an upper transverse annular inwardly opening locking groove and a lower transverse annular inwardly opening catching groove;

said rib carried by the body portion of the split ring is a catching rib adapted to cooperate with said catching groove to restrain the ring against downward movement relative to the hanger body once the catching rib is engaged in the catching groove; and the lock means comprises a second transverse annular outwardly projecting rib located above said catching rib and adapted to cooperate as a locking rib with said locking groove.

3. The combination defined in claim 2, wherein said catching rib is integral with said body portion of said ring.

4. The combination defined in claim 2, wherein said lock means comprises a second resilient split ring disposed in said recess and embracing the mandrel above said first-mentioned ring, said second ring carrying said locking rib.

5. The combination defined in claim 1, wherein said skirt has an outer diameter equal to that of said body portion.

6. The combination defined in claim 1, wherein the juncture between the upper wall of said groove and said first cylindrical outer wall portion is chamfered.

7. The combination defined in claim 1, wherein said flange has an upper face which slants downwardly and inwardly.

8. The combination defined in claim 1, wherein said skirt has a plurality of circumferentially spaced slits extending longitudinally from said body portion through said flange.

9. The combination defined in claim 1, wherein said camming surface of said skirt is frusto-conical;

the inner and outer surfaces of said skirt between said camming surface and said body portion are right cylindrical; and the inner surface portion of said skirt adjacent said flange is frusto-conical and tapers downwardly and inwardly.

10. The combination defined in claim 1, wherein said flange is of such radial extent as to project only partly into said retaining groove when said ring is relaxed and undistorted; and the combination further comprising an annular radially resilient spring disposed in said retaining groove between said flange and the bottom wall of said groove.

* * * * *